US005882175A

United States Patent [19]

Villacieros Fernandez

[11] Patent Number: 5,882,175

[45] Date of Patent: Mar. 16, 1999

[54] STACKER FOR FLEXIBLE SHEETS

[75] Inventor: Jose' Ma Villacieros Fernandez, Vigo, Spain

[73] Assignee: Ward Holding Company, Wilmington, Del.

[21] Appl. No.: 841,757

[22] Filed: Apr. 30, 1997

Related U.S. Application Data

[63] Continuation-in-part of Ser. No. 782,211, Jan. 13, 1997.

[51] Int. Cl.[6] ..... B65G 57/00

[52] U.S. Cl. ..... 414/790; 414/789.8; 414/790.1; 414/790.4; 414/790.8; 271/218

[58] Field of Search ..... 414/788.9, 789.8, 414/790, 790.1, 790.4, 790.8, 794.5; 271/196, 197, 218, 213

[56] References Cited

U.S. PATENT DOCUMENTS

| | | | |
|---|---|---|---|
| 2,631,039 | 3/1953 | Barber, Jr. | 414/788.9 |
| 3,418,895 | 12/1968 | Palmer | 414/790 |
| 3,628,787 | 12/1971 | Boeve | 271/201 |
| 3,698,708 | 10/1972 | Brawn | 414/790 |
| 3,938,674 | 2/1976 | Kroeze et al. | 271/201 |
| 4,133,523 | 1/1979 | Berthelot | 271/182 |
| 4,157,177 | 6/1979 | Atrecker. | 271/197 |
| 4,436,472 | 3/1984 | Kunzmann | 414/50 |
| 4,564,189 | 1/1986 | Noll, Jr. | 271/201 |
| 4,618,138 | 10/1986 | Silverberg | 271/197 |
| 4,642,013 | 2/1987 | Mundus et al. | 414/790.8 |
| 4,796,879 | 1/1989 | Martin et al. | 414/790.8 |
| 4,799,847 | 1/1989 | Bodewein | 414/790.8 |
| 4,878,659 | 11/1989 | Bessemann | 414/790.1 |
| 4,995,859 | 2/1991 | Totani | 271/182 |
| 5,074,743 | 12/1991 | Schaffner et al. | 414/790.8 |
| 5,133,542 | 7/1992 | Von Kwiatkowski et al. | 271/197 |
| 5,265,862 | 11/1993 | Jones et al. | 271/182 |
| 5,290,141 | 3/1994 | Grinager | 414/790.8 |
| 5,439,209 | 8/1995 | Runzi | 271/201 |
| 5,522,693 | 6/1996 | Scheucher et al. | 271/197 |
| 5,548,388 | 8/1996 | Schieck | 271/197 |
| 5,569,016 | 10/1996 | Mokler | 271/182 |
| 5,671,920 | 9/1997 | Acquaviva et al. | 271/182 |

FOREIGN PATENT DOCUMENTS

| | | | |
|---|---|---|---|
| 824002 | 9/1969 | Canada | 414/790 |
| 630787 | 10/1961 | Italy | 414/790.1 |

*Primary Examiner*—Karen M. Young
*Assistant Examiner*—Douglas Hess
*Attorney, Agent, or Firm*—Bartlett & Sherer; Ronald B. Sherer

[57] ABSTRACT

A machine for stacking sheets is disclosed which includes an overhead conveyor for conveying sheets to a stacking area, and first and second sets of support fingers which support the sheets as they are stacked in bundles as the support fingers are moved horizontally and vertically through a predetermined sequence of positions.

14 Claims, 9 Drawing Sheets

VACUUM AREA
32
66
65
67
68
64
60
69
46
C
72

STACKER FOR FLEXIBLE SHEETS

RELATED APPLICATION

This Application is a Continuation-In-Part of application Ser. No. 08/782,211, filed 13 Jan. 1997, the complete disclosure of which is hereby incorporated by reference.

BACKGROUND

The above-identified Application discloses a stacker for stacking sheet materials such as, for example, sheets or blanks of paperboard for making corrugated containers. The blanks are conveyed on the upper surface of a plurality of side-by-side conveyor belts, and the belts are capable of being raised so that the discharge ends may be elevated relative to the inlet ends. The blanks are discharged from the discharge ends of the conveyor belts, after being reduced in velocity, and the blanks drop downwardly onto the stack located below the discharge ends of the conveyors. Preferably, a vertical, forward wall is provided such that the leading edges of the blanks abut the wall and thereby drop in alignment with the other blanks in the stack below.

This type of stacker is well-suited to the stacking of sheets or blanks which are relatively stiff, such as for example, unitary blanks of corrugated paperboard. That is, this type of stacker is well-suited to stacking blanks which are sufficiently rigid so as not to fold or crumple when they are ejected from the conveyor belts, or when they strike the forward wall while falling downwardly onto the stack below. However, many sheet materials are not sufficiently rigid to be handled in this manner. For example, thin paperboard or plastic sheets are not sufficiently rigid, and even relatively thick corrugated paperboard is not sufficiently rigid when it is in the form of an articulated sheet. As used herein, the term "articulated sheet" is intended to denote a sheet of material composed of a plurality of individual parts which are connected together by a plurality of small connecting portions as will be further explained hereinafter. These types of sheet material are too flexible to retain their planar configuration during discharge and stacking. Instead, they will fold upon themselves, or crumple, before they reach the stack below.

In addition to the problem of handling thin or articulated sheets, there is a serious problem of maintaining the stacking function at a speed consistent with that of the die-cutting machine which produces the blanks to be stacked. Such cutters may operate at speeds in the order of 1,000 feet per minute. This is a problem even if relatively tall stacks are to be formed, and it is a much greater problem when the stacks must be relatively short and each short stack must be moved away quickly from the stacking area while the next short stack is being formed. This problem is present in the case of articulated sheets where each stack must be relatively short so as to be able to be separated into individual portions in a downstream breaker as will be more fully described hereinafter.

SUMMARY

The present invention solves all of the above-indicated problems by providing a stacking conveyor which feeds the sheets to an overhead vacuum conveyor which maintains the sheets in planar condition, and then drops the sheets vertically downwardly to the stack below. In addition, the stacker of the present invention includes two sets of horizontal supports, hereinafter referred to as "fingers," which support each stack as it is formed, and rapidly reposition themselves for the formation of the next stack, whereby the speed of operation is dramatically increased to as to be fully compatible with high-speed die cutters.

DETAILED DESCRIPTION

Figure 1:
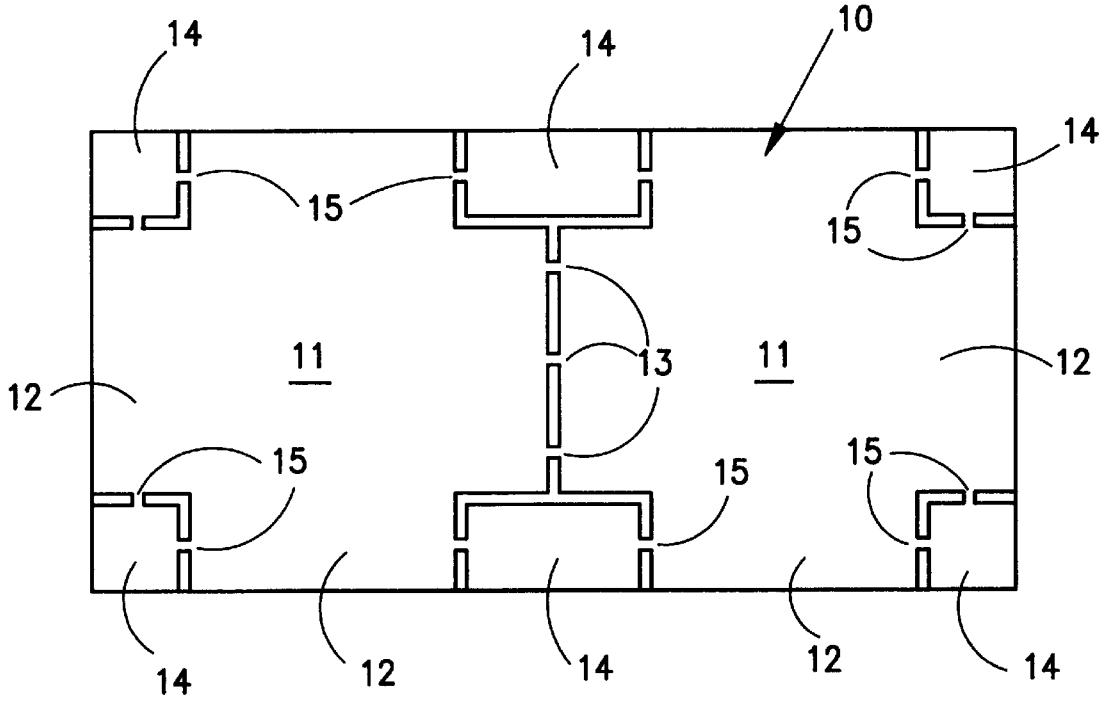
FIG. 1 is a top view of an articulated sheet.

Referring to FIG. 1, an articulated sheet 10 is shown which, solely for purposes of illustration, comprises two container tops 11 with flaps 12. Tops 11 are connected to each other by thin connecting portions 13, and the articulated sheet further includes six scrap portions 14 connected by thin connecting portions 15. Such a sheet is very flexible due to the thin connecting portions 13 and 15, and many articulated sheets contain many more individual product and scrap portions than that illustrated in FIG. 1. Thus, articulated sheets are very difficult to stack without folding, and the present invention solves this problem as well as the other problems indicated above.

Figure 2:
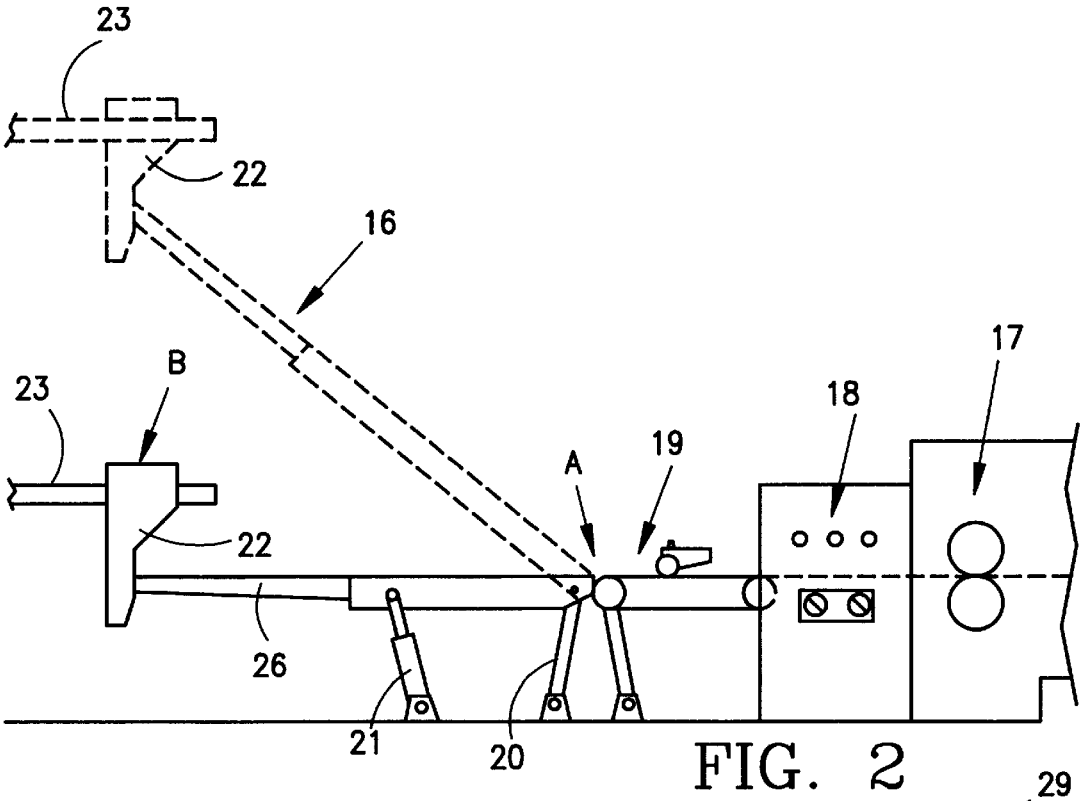
FIG. 2 is a schematic side elevational view of a die cutter and the major portion of the stacking conveyor.

Referring to FIG. 2, and by way of background, stacking conveyor 16 is generally preceded by a die cutter section schematically illustrated at 17 which cuts and slots the sheets to form flaps, tabs and articulated sheets. Of course, cutter section 17 may be preceded by a printing section not shown. The sheets usually pass over an optional vibratory conveyor, not shown, located behind control center 18, and then over a table 19 which may be used to shingle the sheets if desired. The sheets then pass onto inlet end A of the stacking conveyor 16. Stacking conveyor 16 is pivoted at inlet end A, and is supported by a pivoted connecting rod 20. A pneumatic or hydraulic cylinder 21 is connected at a point spaced from end A such that the stacking conveyor may be elevated from the horizontal position to the raised position shown in FIG. 2 in dotted line. It will also be understood that because of the articulated nature of connecting rod 20 and cylinder 21, the discharge end B of the stacking conveyor remains in vertical alignment as the discharge end is raised and lowered throughout its operating range in the course of forming a vertically arranged stack of sheets.

Figure 3:
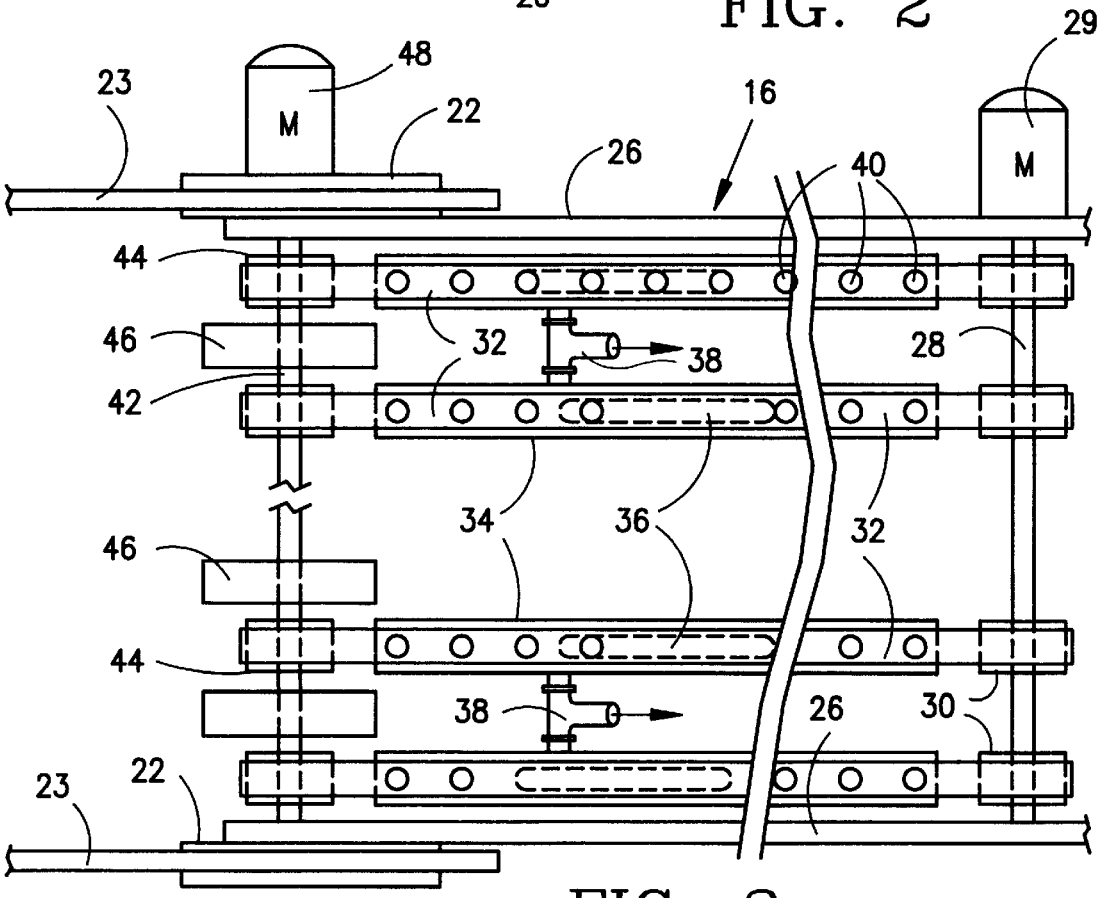
FIG. 3 is a top view looking down on the stacking conveyor of FIG. 2.

As further shown in FIGS. 2 and 3, the discharge end of the stacking conveyor carries side-mounted support plates 22 which, in turn, support horizontally extending arms 23. Arms 23 may support a vertical wall, not shown, against which the forward edges of the container blanks abut as they are discharged from the discharge end B of the stacking conveyor as described in the above-identified Application.

However, for highly flexible sheets, such as the articulated sheets described above, the vertical wall is eliminated and arms 23 are used to support an overhead vacuum conveyor as will be described hereinafter.

The general construction of the stacking conveyor is illustrated schematically in FIG. 3 which shows a pair of side arms 26 which may be of box-beam construction. As shown in the right-hand portion of FIG. 3, side arms 26 support a drive shaft 28 which is driven by a motor 29. A plurality of drive pulleys 30 are mounted on and driven by shaft 28, and pulleys 30 drive a plurality of parallel-extending conveyor belts 32 spaced across the width of the stacking conveyor. Side arms 26 also support a plurality of hollow belt-support members 34 which may have square or rectangular cross-section. Members 34 support the underneath side of the upper reaches of the belt and include elongated slots 36; only a few of the slots being shown for purposes of clarity. Hollow belt-support members 34 are connected through hose and fitting assemblies 38 to a source of subatmospheric pressure such as the suction side of a vacuum pump or blower not shown. In this manner, a partial vacuum is created within hollow belt-support members 34, and this partial vacuum is transmitted to the underneath sides of the sheets on the conveyor belts through slots 36 in the hollow members and through holes 40 in the conveyor belts. As a result, even though the speed of the conveyors may be as high as 1,000 feet per minute, and even though the angle of the conveyors may be raised as high as 21 degrees with respect to the horizontal, the sheets are maintained in tight frictional engagement with the upper surfaces of the conveyor belts so that the sheets do not slip with respect to the belts.

Figures 4A, 4B:
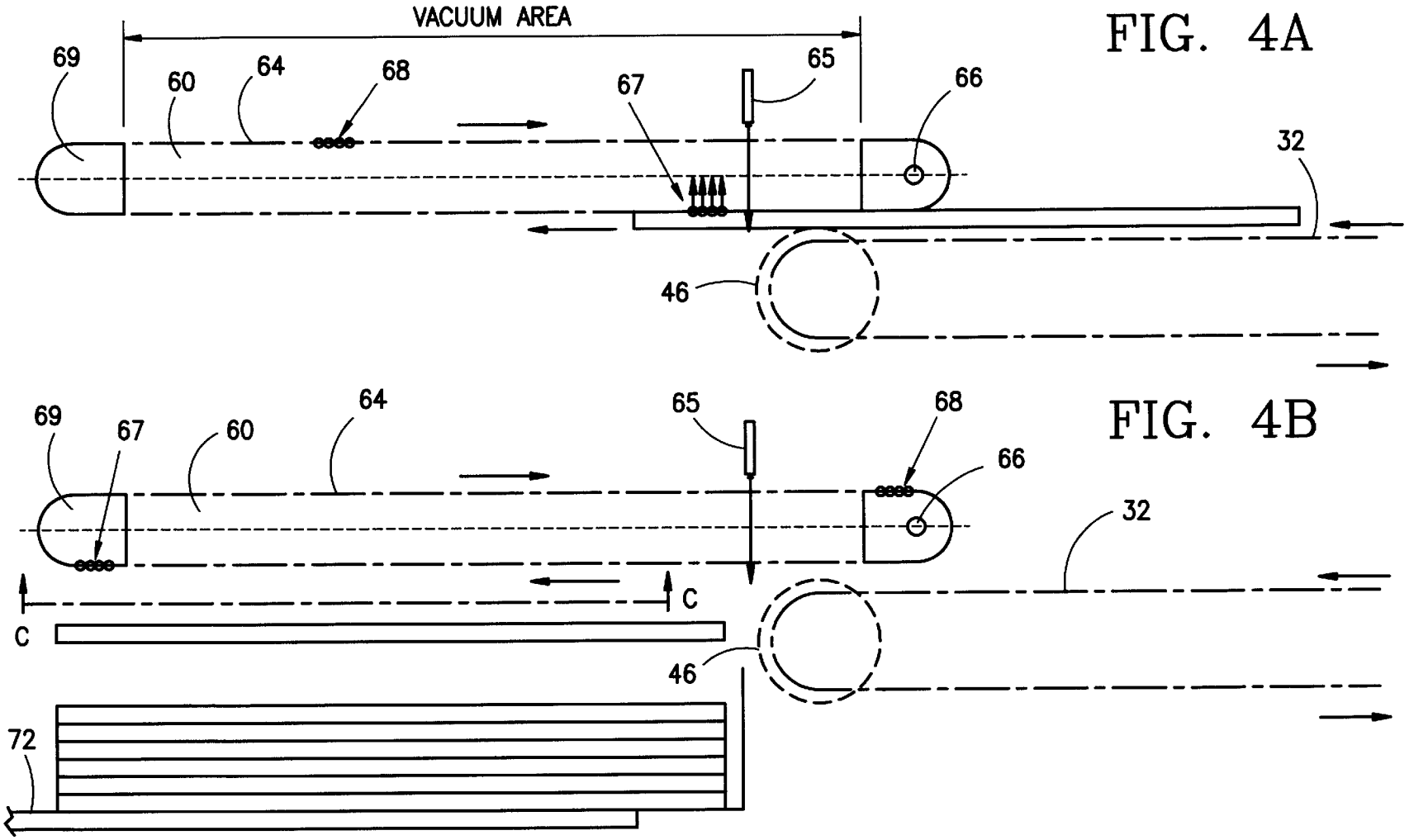
FIGS. 4A and B are diagrammatical side views showing a portion of the stacking conveyor and the overhead vacuum conveyor in operation.

At the discharge end B of the stacking conveyor as shown in FIG. 3, side arms 26 support a second shaft 42 and a plurality of idler pulleys 44 are mounted on shaft 42 by internal bearings 45 so that conveyor belts 32 and idler pulleys 44 are free to rotate at the line speed determined by motor 29 and drive pulleys 30. Shaft 42 also carries a plurality of wheels 46 which are connected to the shaft so as to rotate at a variable speed as determined by variable speed motor 48. It will be noted that the diameters of wheels 46 are larger than the diameters of idler pulleys 44 such that, as the forward portion of each sheet passes over wheels 46, as shown in FIG. 4A, the forward portion of the sheet is forced or wedged away from belts 32 so that the suction force acting on the bottom of the forward portion of the sheet is substantially decreased or eliminated. This forcing or wedging action continues as the sheet continues to pass over wheels 46 such that the sheet becomes freed of the suction of belts 32 and may be picked up by overhead vacuum conveyor 50 which will now be described with reference to FIGS. 4A, B and 5.

Figure 4C:
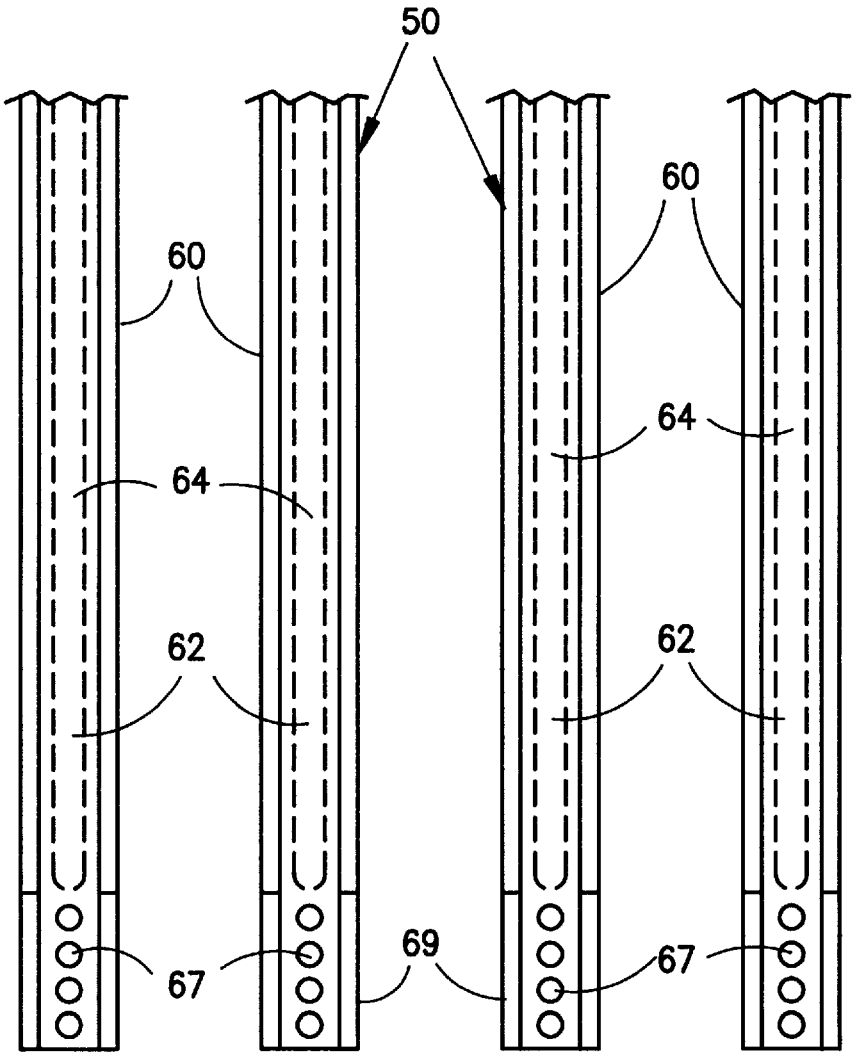
FIG. 4C is a bottom view of four of the overhead vacuum conveyors taken along the view line C—C of FIG. 4B.
Figure 5:
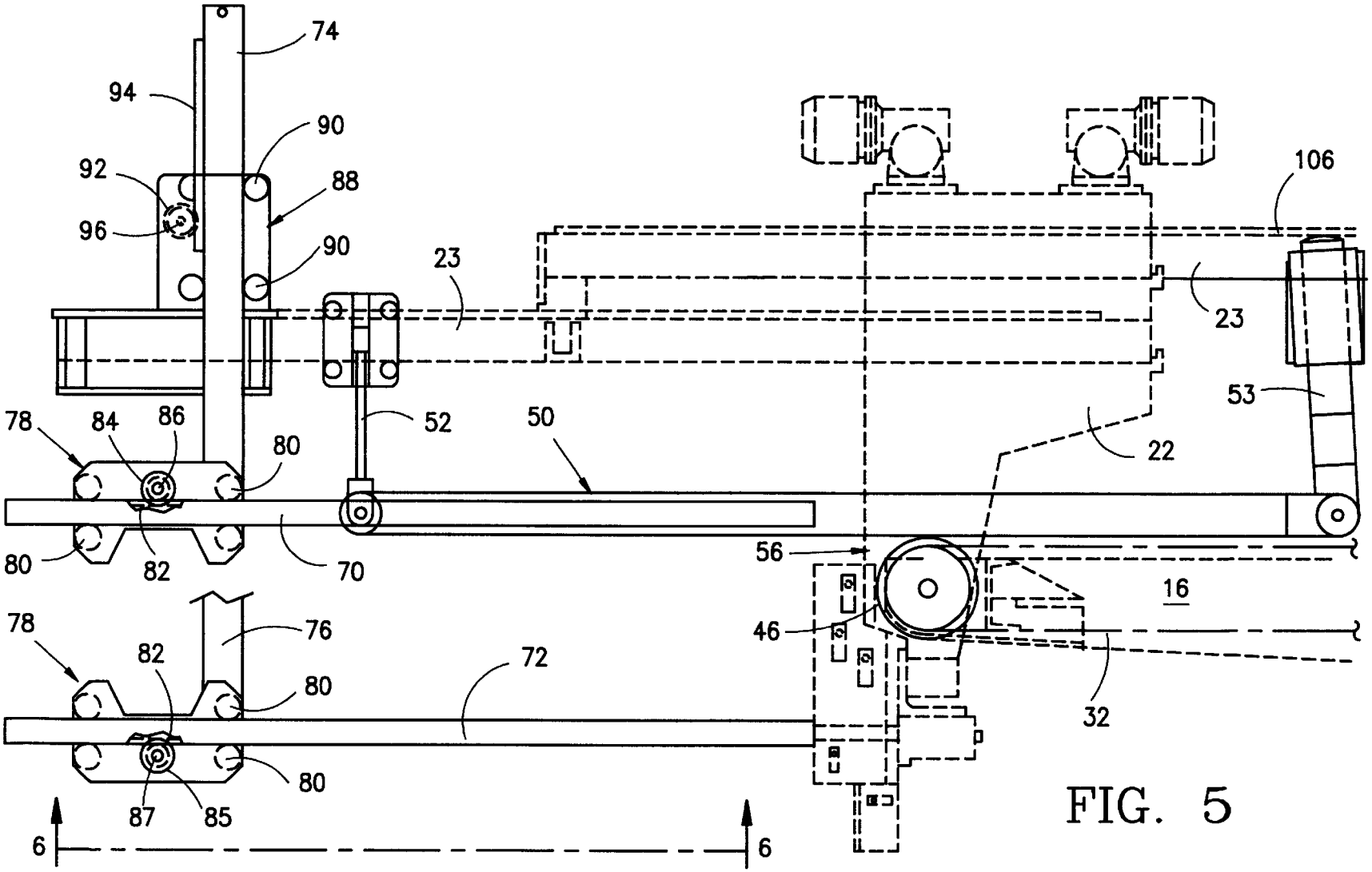
FIG. 5 is a schematic side elevational view showing the conveyors and the upper and lower fingers for supporting the stacks.

Referring first to FIG. 5, stacking conveyor 16 is shown in a horizontal position which is the position used when only short stacks are to be formed. Arms 23 support a plurality of pairs of vertical supports 52 and 53, which in turn support a plurality of side-by-side overhead vacuum conveyors 50 as further shown in FIG. 4C. It will be noted that the inlet ends 54 of overhead conveyors 50 overlap the discharge ends 56 of stacking conveyors 32, and that the bottom reaches of the overhead conveyors 50 are spaced a small distance, such as a few inches, above the upper reaches of stacking conveyors 32.

The operation and further details of the overhead conveyors are shown in FIGS. 4A, 4B and 4C. Each overhead conveyor includes an elongated hollow housing 60 with an elongated slot, or series of apertures, 62 in the bottom surface as shown in the fragmentary view of FIG. 4C. It will be readily understood that each of housings 60 is connected by hollow conduits (not shown) to a source of partial vacuum, such as the suction inlet of a vacuum pump or blower, not shown. Each of housings 60 is surrounded by a conveyor belt 64 which is driven through a common drive shaft 66 by a motor, not shown. Each of belts 64 is provided with two sets of apertures 67, 68 which are positioned 180° apart around the circumference of the belt. Thus, when belts 64 are driven in the direction of the arrows in FIGS. 4A and B, one set of apertures 67 moves past one of discharge wheels 46 such that, just as a sheet is being raised by wheels 46 and released from the suction effect of stacking conveyor belts 32, the sheet comes under the influence of the suction from apertures 67. The sheet is thereby drawn upwardly into firm engagement with overhead belts 64. The sheet is then conveyed forwardly as shown in FIG. 4B until the trailing end of the sheet clears the discharge end of the stacking conveyor. At this point, the set of apertures 67 in belt 64 has moved beyond the extent of the slot or holes 62 in the bottom of housing 60 such that the suction is cut off by the solid end 69 of the housing. The sheet is then released and falls downwardly onto the stack below as shown in FIG. 4B.

It will also be understood that, for very thin or highly flexible sheets, more than one set of apertures may be provided along the length of belts 64 so as to provide multiple points of suction along the length of the sheet, and the sheet may be released by valve means (not shown) cutting off the vacuum supply. Alternatively, the sheets may be pushed downwardly or otherwise ejected by mechanical means not shown. It will also be understood that the timing sequence of belts 32 and 64 may be controlled by a timer or other synchronized operation of belts 32 and 64. However, it is preferred that a proximity sensor 65 be located at the discharge end of belts 32 so as to detect the presence of each sheet. Sensor 65 then sends a signal to the motor driving shaft 66 which actuates the motor to drive belt 64 and thereby convey the sheet to the release position shown in FIG. 4B in which each sheet is stacked in a planar condition on a set of stacking fingers 70, 72 as will now be described.

Figure 6:
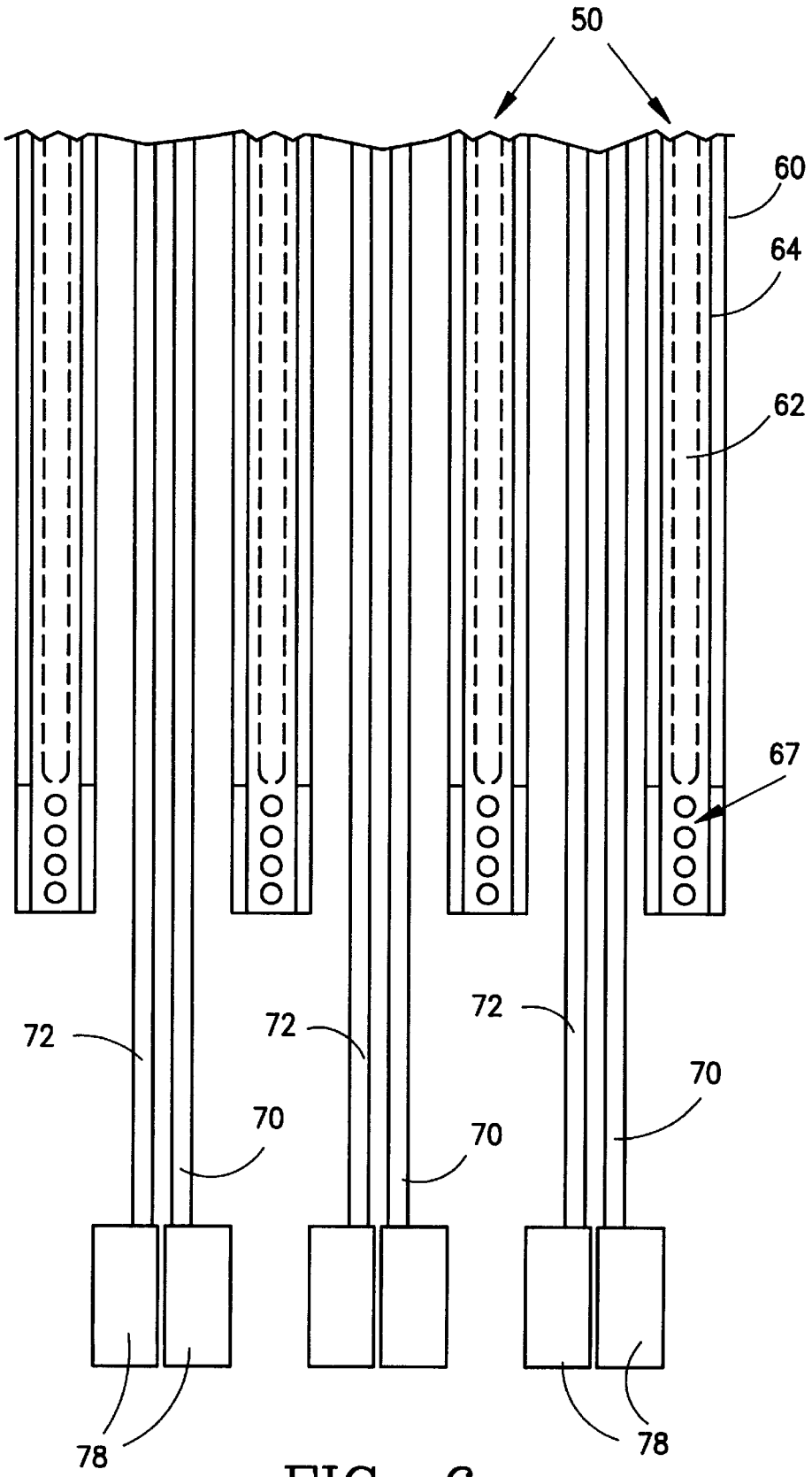
FIG. 6 is a fragmentary view looking upwardly along view line 6—6.

Referring to FIG. 5, the forward ends of arms 23 support a plurality of vertical supports 74 and 76. Each vertical support 74 and 76 is connected to a horizontal drive housing 78. Each housing receives a support finger 70 or 72 which is guided for reciprocation horizontally by bearings 80. Each of the support fingers includes a toothed portion 82, and each toothed portion 82 is engaged by a drive gear 84 or 85 mounted on common drive shafts 86 and 87. Thus, gears 84, 85 and toothed portions 82 constitute rack-and-pinion drives which cause fingers 70 and 72 to move horizontally, forwardly and rearwardly upon rotation of common drive shafts 86 and 87 in the counter-clockwise or clockwise direction, respectively, as viewed in FIG. 5. Similarly, each of vertical supports 74 and 76 is received in a drive housing 88; only the drive housing 88 for vertical support 74 being shown. However, it will be readily understood that an identical drive housing 88 is provided for vertical support 76. Drive housings 88 include four bearings or rollers 90 which guide the vertical movement of supports 74 and 76. The drive housings also include drive gears 92 which engage toothed racks 94 secured to the vertical supports. Drive gears 92 are driven by common drive shafts 96 such that, upon clockwise rotation of gears 92 the vertical supports and associated support fingers 70, 72 are moved downwardly, and upon counter-clockwise rotation of the gears, the vertical supports and associated support fingers 70, 72 are moved upwardly. As shown schematically in the partial view of FIG. 6, the set of lower support fingers 72 is spaced laterally relative to the set of upper support fingers 70 such that the two sets of support fingers may move horizontally and vertically relative to each other in order to perform the sequence of movements as will now be described with reference to FIGS. 7–13.

Figure 7:
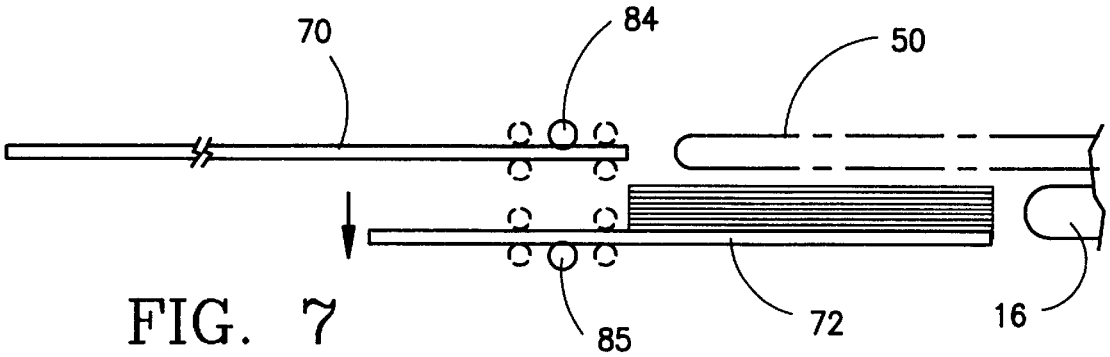
FIGS. 7–13 are schematic illustrations of the sequence of positions of the fingers during formation of the stacks.
Figure 8:
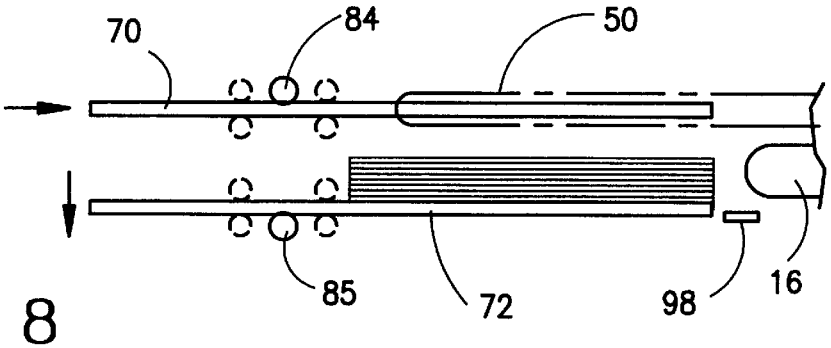

FIG. 7 illustrates the positions of support fingers 70 and 72 while a stack of sheets is being formed. At this time, the sheets are being conveyed to the stacking area by stacking conveyor 16, and each sheet is sequentially engaged by the suction of overhead vacuum conveyor 50 and conveyed over the stack. The vacuum is then cut off or the sheet is otherwise disengaged, as previously described, and the sheet drops downwardly onto the stack below. The stack is supported by lower support fingers 72 which move downwardly as the stack is formed. When the desired number of sheets is being approached, as may be determined by a counter or proximity switch 98 sensing the lowered position of support fingers 72, a signal is sent to the motor driving gears 84 such that the support set of fingers 70 are moved from left to right into the position shown in FIG. 8. In this position, fingers 70 are extending between adjacent overhead conveyors 50 just slightly above the lower reaches of belts 64 while the conveyors continue to deliver sheets to the stack.

Figure 9:
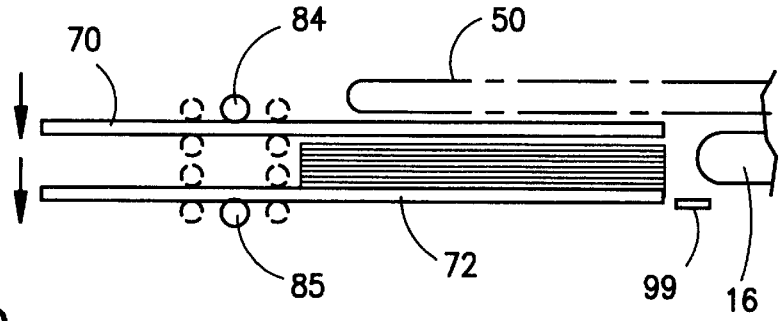
Figure 10:
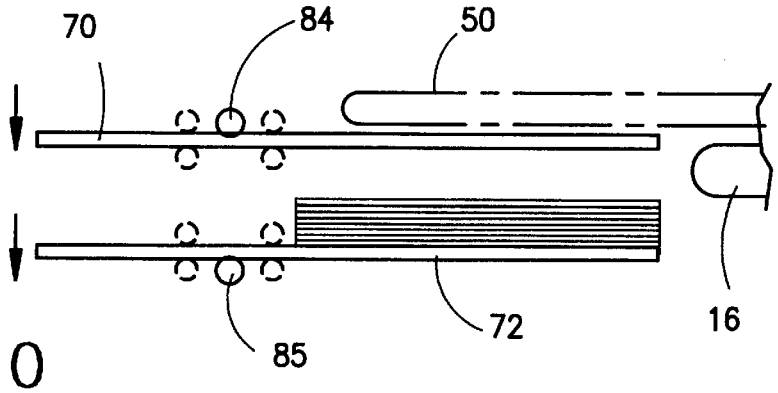
Figure 11:
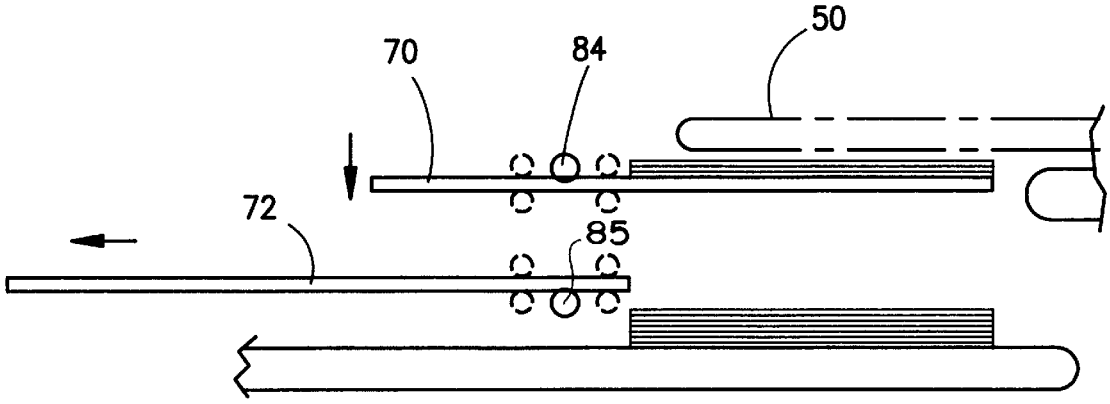

When the stack is completed, as shown in FIG. 9, a counter or sensor 99 sends a signal to the motor driving gear 92 (FIG. 5) whereby upper fingers 70 are rapidly moved downwardly to a position just below the bottom reaches of overhead conveyors 50. This downward movement of upper fingers 70 is only a distance of one or a few inches such that this movement is effected after the last sheet is dropped onto the stack and before the next sheet is fed to the overhead conveyor by the stacking conveyor. Upper support fingers 70 are then in position to support the next stack as shown in FIG. 10 without any interruption or delay in the feeding of the sheets by conveyors 16 and 50. Both sets of support fingers are then moved downwardly as shown in FIG. 11 until lower fingers 72 are just above a transfer conveyor 100. At this point, lower support fingers 72 are retracted by gears 85 and the stack drops a short distance onto transfer conveyor 100. Conveyor 100 conveys the stack to the next station which may be for bundling or for breaking the product portions of articulated sheets from the scrap portions as previously indicated.

Figure 12:
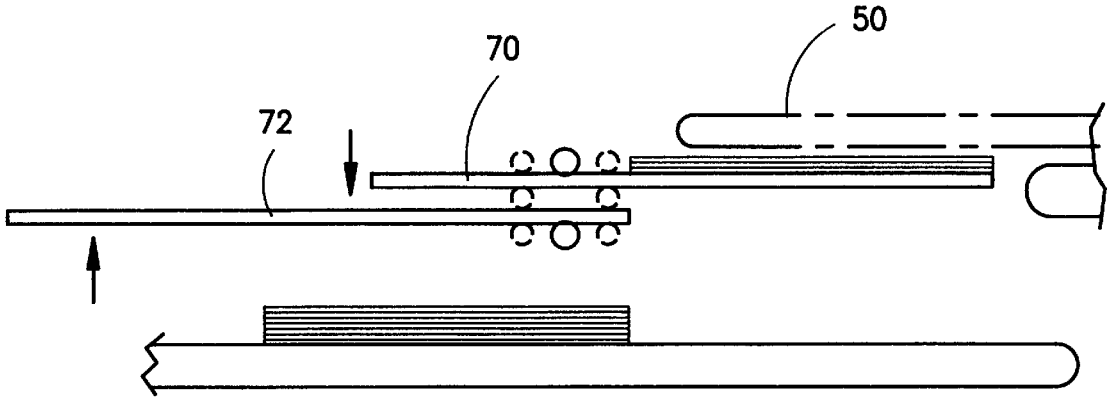
Figure 13:
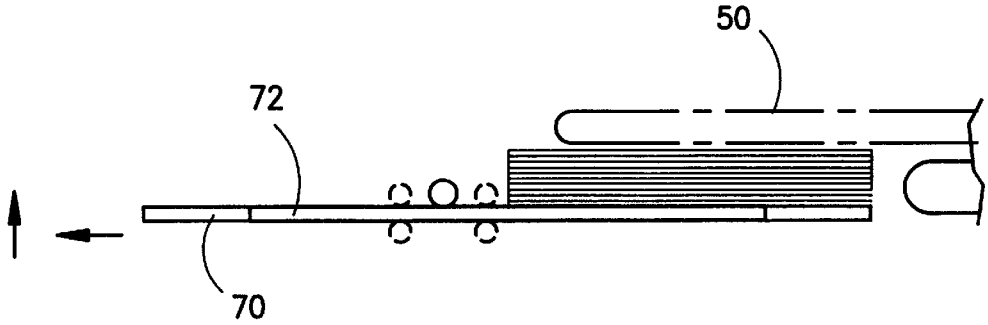
Figure 14:
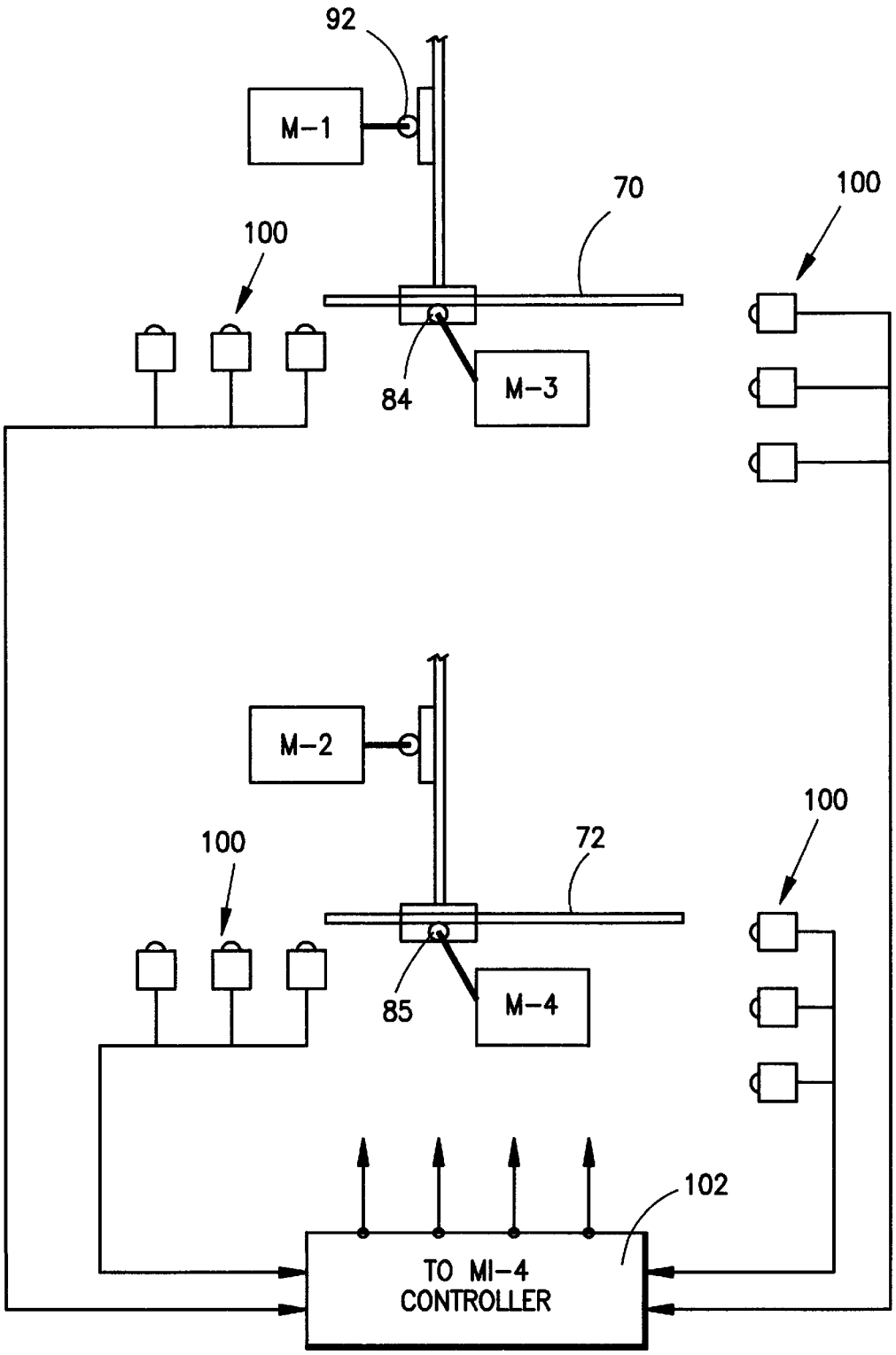
FIG. 14 is a schematic control diagram.

As soon as lower fingers 72 have been retracted from beneath the stack, lower fingers 72 are moved upwardly as shown in FIG. 12 while upper fingers 70 continue to support the newly forming stack and move downwardly. As shown in FIG. 13, lower fingers 72 are moved upwardly to a position slightly above upper fingers 70 so that the new, partially formed stack becomes supported by lower fingers 72. This allows upper fingers 70 to be retracted to the left while the formation of the stack continues uninterrupted. With the new stack supported by lower fingers 72, and upper fingers 70 retracted, the elements are returned to the starting position shown in FIG. 7 and the above-described cycle is repeated with no interruption or delay in conveying the sheets form the die cutter to the stacked product. Thus, the present stacker can handle very flexible and difficult-to-handle sheets, and at an operating speed which enables the high-speed upstream functions, such as printing and/or die cutting, to operate at their maximum speed without interruption. Of course, it will be readily apparent to those skilled in the art that a wide variety of control systems may be utilized to position support fingers 70 and 72 as just described. For example, multiple sets of position sensors 100 may be used to sense the positions of the fingers and send signals to controller 102 which then actuates motors M-1, 2, 3 and 4 as shown schematically in FIG. 14. Also, it will be apparent from FIGS. 7–13 that the length of supporting fingers 70, 72 may be sufficient to extend below the entire length of the sheets in a stack or, as shown in FIG. 4B, the length may be slightly less. In either event, supporting fingers 70, 72 support the full weight of the stacks as described and illustrated.

It will be understood that the foregoing description of one preferred embodiment is intended to be illustrative of the principles of the invention, rather than exhaustive, and that the invention is not intended to be limited other than as set forth in the following claims interpreted under the doctrine of equivalents.

What is claimed is:

1. A machine for stacking flexible sheets into a plurality of separate stacks comprising:

(a) conveyor means for successively conveying individual sheets into a stacking area;

(b) first and second sets of support fingers extending horizontally in said stacking area;

(c) said support fingers having lengths sufficient to support the entire weight of said stacks;

(d) means for moving said first set of support fingers horizontally between a retracted position and an extended stacking position;

(e) means for moving said second set of support fingers horizontally between a retracted position and an extended stacking position;

(f) means for moving said first set of support fingers vertically;

(g) means for moving said second set of support fingers vertically so as to sequentially support the full weight of said stacks on said first and second sets of support fingers and (h) control means for simultaneously moving said first and second sets of fingers vertically in said stacking area.

2. The machine of claim 1 wherein said conveyor means comprises an overhead vacuum conveyor, said vacuum conveyor extending directly above said first and second sets of support fingers; and means for terminating the vacuum in said vacuum conveyor means as each of said sheets has been conveyed above said support fingers.

3. The machine of claim 1 comprising a first set of vertically extending supports for supporting said first set of support fingers, and a second set of vertically extending supports for supporting said second set of support fingers.

4. The machine of claim 3 wherein said means for moving said first set of support fingers vertically comprise rack and pinion gears.

5. The machine of claim 3 wherein said means for moving said first set of support fingers horizontally comprise rack and pinion gears.

6. The machine of claim 1 including control means for controlling the movements of said first and second sets of support fingers such that:

(a) said first set of fingers is moved horizontally and vertically such as to entirely support a first stack of sheets delivered by said conveyor, and (b) said first set of support fingers is moved downwardly while supporting said stack, and (c) said second set of support fingers is moved vertically and horizontally such as to entirely support the next stack of sheets.

7. The machine of claim 6 wherein said control means move said first set of support fingers such as to transfer a stack of sheets from said second set of support fingers to said first set of support fingers while said sheets continue to be delivered to said stacking area.

8. A stacking machine for stacking flexible sheets into a plurality of separate stacks comprising:

(a) first and second sets of support fingers extending horizontally in a stacking area;

(b) said support fingers having lengths sufficient to support the entire weight of said stacks;

(c) means for moving said first set of support fingers horizontally between a retracted position and an extended stacking position;

(d) means for moving said second set of support fingers horizontally between a retracted position and an extended stacking position;

(e) means for moving said first set of support fingers vertically; and (f) means for simultaneously moving said second set of support fingers vertically in said stacking area so as to transfer the weight of a stack from said first set of support fingers to said second set of support fingers.

9. The stacking machine of claim 8 wherein said means for moving said first and second sets of support fingers horizontally and vertically comprise rack and pinion gear means.

10. The stacking machine of claim 8 including control means for actuating said means for moving said first and second sets of support fingers horizontally and vertically such that said stacks are initially formed on said first set of support fingers and, as said first set of support fingers are moved downwardly by said control means, said second set of support fingers are moved horizontally and vertically into a position to support the next stack.

11. The stacking machine of claim 8 wherein said means for moving said first and second sets of support fingers horizontally comprise rack and pinion gear means.

12. The stacking machine of claim 8 wherein said means for moving said first and second sets of support fingers vertically comprise rack and pinion gear means.

13. A stacking machine for stacking flexible sheets into a plurality of separate stacks in a stacking area comprising:

(a) means for conveying individual sheets of flexible material into said stacking area;

(b) first and second sets of elongated horizontally extending support elements;

(c) said elongated horizontal support elements having lengths sufficient to support said stacks with said flexible sheets lying in a horizontal planar orientation;

(d) actuating means for moving said first and second elongated support elements horizontally and vertically in said stacking area; said actuating means moving said second set of elongated support elements vertically to a height at least as high as the height of said first set of elongated support elements; and (e) control means for moving said actuating means for transferring a stack from one of said sets of elongated support elements to the other while said means for conveying continue to convey said sets uninterrupted.

14. The stacking machine of claim 13 wherein each of said support elements include toothed rack means, and said actuating means comprise gears engaging said toothed rack means.

* * * * *